US005565975A

United States Patent [19]

Kumon et al.

[11] Patent Number: 5,565,975

[45] Date of Patent: Oct. 15, 1996

[54] COLOR IMAGE FORMING APPARATUS AND METHOD HAVING TONER IMAGES TRANSFERRED TO A PAPER SHEET

[75] Inventors: Akira Kumon, Katano; Junichi Nawama, Osaka, both of Japan

[73] Assignee: Matsushita Electric Industrial Co., Ltd., Osaka, Japan

[21] Appl. No.: 475,356

[22] Filed: Jun. 7, 1995

[30] Foreign Application Priority Data

Jun. 10, 1994 [JP] Japan ..... 6-128947
Jun. 28, 1994 [JP] Japan ..... 6-146318

[51] Int. Cl.[6] ..... G03G 15/01

[52] U.S. Cl. ..... 355/326 R; 118/645; 355/274

[58] Field of Search ..... 355/271, 273, 355/274, 275, 326 R, 327; 347/115, 138, 152; 118/645

[56] References Cited

U.S. PATENT DOCUMENTS 5,196,893 3/1993 Nishise et al. ..... 355/271
5,291,252 3/1994 Kawaishi ..... 355/271 X
5,300,984 4/1994 Fuma et al. ..... 355/275 X
5,351,115 9/1994 Yamamoto et al. ..... 355/326 R

FOREIGN PATENT DOCUMENTS 3-214173 9/1991 Japan .
5-61316 3/1993 Japan .
5-72910 3/1993 Japan .
5-119642 5/1993 Japan .
5-181395 7/1993 Japan .
6-11943 1/1994 Japan .

*Primary Examiner*—William J. Royer
*Attorney, Agent, or Firm*—Fish & Richardson

[57] ABSTRACT

A color image forming apparatus forming toner images of yellow, magenta, cyanogen and black respectively by rotational movement of different image forming units is described. The toner images are transferred to and superimposed on an intermediate transfer belt and then re-transferred to a paper sheet by pressing a transfer roller on the intermediate transfer belt via the paper sheet. A rotational axis of the transfer roller is immovable, and a potential of the transfer roller is electrically floated while the toner images are transferred to the intermediate transfer belt.

19 Claims, 4 Drawing Sheets

COLOR IMAGE FORMING APPARATUS AND METHOD HAVING TONER IMAGES TRANSFERRED TO A PAPER SHEET

FIELD OF THE INVENTION

This invention relates to a color image forming apparatus such as a document copier, a facsimile or a printer, and a method for forming a color image which is used in the color image forming apparatus.

BACKGROUND OF THE INVENTION

Generally, in an electrophotographic type color image forming apparatus, an original picture image is optically or electrically separated in the primary colors. A latent image corresponding to each color of yellow, magenta or cyanogen is formed on a surface of a photoreceptor. The latent image is developed by a toner which corresponds to each color. The developing method of each color is substantially the same as a method for a conventional monochromatic image forming apparatus. However, there are several types for superimposing a toner image of each color on a medium which is to transfer the color image.

A first conventional color image forming apparatus, which is, for example, shown in a Publication Gazette of Unexamined Japanese Patent Application Hei 6-11943, or Hei 3-214173, is comprised of a charging device which is disposed in the vicinity of the outer periphery of a photoreceptor for charging a surface of the photoreceptor, an exposing device for exposing the surface of the photoreceptor selectively, and a plurality of developing devices respectively corresponding to yellow, magenta, cyanogen and black. A paper sheet, to which the color image is to be transferred, is electrostatically attracted on a surface of a transfer drum made of dielectrics. Toner images corresponding to respective colors are superimposed on the surface of the paper sheet by the developing devices.

Operations of the above-mentioned first conventional color forming apparatus are described. Initially, a color document is read by an image scanner, and image information data corresponding to yellow, magenta, cyanogen and black are obtained. These image information data are temporarily stored in a memory. Next, a latent image based on, for example, yellow image data is formed on the surface of the photoreceptor by the exposing device. The latent image on the surface of the photoreceptor is developed by the developing device corresponding to yellow, and a toner image of yellow is formed on the surface of the photoreceptor. In synchronism with the image forming operation on the photoreceptor, a paper sheet is supplied on the transfer drum. The toner image of yellow is electrostatically transferred on the surface of the paper sheet on the transfer drum by a corona discharger. Similarly, toner images of magenta, cyanogen and black are serially formed, and superimposed on the toner image of yellow on the surface of the paper sheet on the transfer drum. The electrostatic attraction force is released by another corona discharger for removing the electric charge. The paper sheet holding the toner images of four colors are peeled off from the transfer drum, the toner images on the paper sheet are fixed by a fixing process, and the paper sheet is ejected from the color image forming apparatus.

In a second conventional color image forming apparatus shown, for example, in a Publication Gazette of Unexamined Japanese Patent Applications Hei 5-61316, Hei 5-181395, Hei 5-119642, or Hei 5-72910, a toner image of each color, which is formed on a surface of a photoreceptor, is transferred to and held on a surface of an intermediate transfer belt in order to prevent trouble due to the paper supply. The toner images are superimposed on the intermediate transfer belt, and transferred to a surface of a paper sheet together. In the second conventional color image forming apparatus, a configuration of a charging device, an exposing device and developing devices which are disposed in the vicinity of an outer periphery of the photoreceptor is substantially the same as the first conventional color image forming apparatus shown in the Publication Gazette of Unexamined Japanese Patent Application Hei 6-11943. The intermediate transfer belt, however, spans a plurality of pulleys. One of the pulleys is driven to contact and separate the surface of the photoreceptor with the intermediate transfer belt. The toner images which are formed on the surface of the photoreceptor are serially transferred to and superimposed on the surface of the intermediate transfer belt in an order of, for example, yellow, magenta, cyanogen and black. When the toner images of four colors are superimposed on the intermediate transfer belt, a paper sheet is supplied in a manner so that the top of the paper sheet and the top of the toner images on the intermediate transfer belt coincide with each other. After that, a transfer roller, which is made of a conductive material and a predetermined voltage is applied, is contacted on the back of the paper sheet for pushing the surface of the paper sheet on the intermediate transfer belt. Thereby, the toner images are transferred to the paper sheet from the intermediate transfer belt. The conductive transfer roller is placed at a position distant from the intermediate transfer belt, while the toner images are superimposed on the intermediate transfer belt. The transfer roller contacts the intermediate transfer belt via the paper sheet only when the toner images on the intermediate transfer belt are transferred to the paper sheet. The paper sheet holding the toner images of four colors passes a fixing process and is exhausted to the outside of the color image forming apparatus.

In the above-mentioned first conventional color forming apparatus, however, the paper sheet is wound on the transfer drum for forming the toner images of the primary three colors and black. Thus, the apparatus includes the processes for electrostatically attracting the paper sheet on a transfer drum and for peeling off the paper sheet from the transfer drum by removing the electrostatic force by the corona dischargers. During the processes, a lot of ozone which is harmful is generated by the corona dischargers. Furthermore, a paper path of the paper sheet becomes complex and the complexity of the paper path can cause a paper jam. In particular, recovery from the paper jam becomes complex.

On the other hand, in the second conventional color image forming apparatus, the toner images are transferred from the photoreceptor to the intermediate transfer belt, and the superimposed toner images are transferred from the intermediate transfer belt to the paper sheet again. Thus, the paper path becomes more simple than that of the first conventional color image forming apparatus. Furthermore, since the electrostatic force by the corona discharger is not used, not as much harmful ozone is generated. However, a mechanism, which separates the transfer roller from the intermediate transfer belt while the toner images formed on the photoreceptor are superimposed on the intermediate transfer belt, is necessary. Thus, the driving mechanisms of the apparatus becomes complex.

SUMMARY OF THE INVENTION

An objective of this invention is to simplify a configuration of a color image forming apparatus, in which toner images are transferred to and superimposed on an intermediate transfer belt, and the superimposed toner images are re-transferred to a paper sheet. Thereby, a high resolution and high quality color picture image can be obtained with a high maintenance and low running cost.

Another objective of this invention is to provide a method for forming a color image, which is suitable to the above-mentioned color image forming apparatus of this invention.

For attaining the above-mentioned objectives, a color picture image forming apparatus of this invention comprises, a plurality of image forming units which are circularly arranged and revolutionally movable, and respectively having a rotating photoreceptor, charging means for electrically charging a surface of the photoreceptor, developing means containing different colored toner, and cleaning means for removing the toner remained on the photoreceptor, an endless intermediate transfer belt having conductivity and a surface to which toner images formed by the image forming units are transferred and superimposed thereon, paper sheet charging means for charging a surface of a paper sheet previously before a transfer of the toner images from the intermediate transfer belt, a conductive electrode for nipping the paper sheet which is previously charged by the paper sheet charging means between the conductive electrode and the intermediate transfer belt, voltage supplying means for supplying a predetermined voltage to the conductive electrode when the toner images superimposed on the intermediate transfer belt are transferred to the paper sheet, and switching means for turning off a circuit between the conductive electrode and said voltage supplying means to make the conductive electrode electrically float when the toner images of respective colors are superimposed on the intermediate transfer belt and the paper sheet does not exist between the intermediate transfer belt and the conductive electrode, and for turning on the circuit to apply the voltage to the conductive electrode when the toner images superimposed on the intermediate transfer belt are transferred to the paper sheet.

On the other hand, a method for forming a color picture image of this invention comprises steps of, revolutionally moving a plurality of image forming units, which are circularly arranged and respectively have a rotating photoreceptor, charging means for electrically charging a surface of the photoreceptor, developing means containing different colored toner, and cleaning means for removing the toner remaining on the photoreceptor, in a manner so that one of the image forming units stops at a position facing an intermediate transfer belt, forming a toner image on the photoreceptor in the image forming unit when stopping at the position, transferring the toner image from the photoreceptor to a surface of the intermediate transfer belt, repeating the above-mentioned steps until the toner images corresponding to all the different colors are transferred to and superimposed on the surface of the intermediate transfer belt, electrically charging a surface of a paper sheet before transferring toner images from the intermediate transfer belt to the paper sheet, switching off a conductive electrode, which nips the paper sheet together with the intermediate transfer belt, for electrically floating when the toner images are superimposed on the intermediate transfer belt and the paper sheet is not between the intermediate transfer belt and the conductive electrode, and switching on the conductive electrode for supplying a predetermined voltage thereto when the toner images superimposed on the intermediate transfer belt are transferred to the paper sheet.

By the above-mentioned configurations, since a plurality of toner images which are superimposed on the surface of the intermediate transfer belt are transferred to the surface of the paper sheet at the same time, the paper sheet is brought into a contacting position of the intermediate transfer belt and the conductive electrode only one time. Thus, the paper path becomes simple. Furthermore, a plurality of toner images corresponding to, for example, yellow, magenta, cyanogen and black, which form a color picture image, are superimposed on the intermediate transfer belt. The conductive electrode, to which a predetermined voltage is applied, is pressed on the back face of the paper sheet, so that the toner images on the intermediate transfer belt are transferred to the surface of the paper sheet.

Conventionally, the conductive electrode, which is to contact the surface of the intermediate transfer belt, was mechanically separated from the surface of the intermediate transfer belt while the toner images are superimposed on the transfer belt for preventing the re-transfer of the toner from the intermediate transfer belt to the conductive electrode. However, the conductive electrode is electrically floated while the toner images are superimposed on the intermediate transfer belt. Thus, even when the conductive electrode, such as a transfer roller is always in contact with the intermediate transfer belt, the toner will hardly be re-transferred to the conductive electrode. Namely, the conductive electrode can be made immovable, and the separating device of the conductive electrode can be omitted. Additionally, the paper sheet is electrically charged prior to being supplied between the conductive electrode and the intermediate transfer belt, so that the conductive electrode can be grounded instead of being applied a predetermined voltage. Thus, the electric power supply can be omitted.

Furthermore, it is preferable that the paper sheet charging means is comprised of a grounded conductive guide, a semiconductive electrode facing and contacting the conductive guide, and transfer voltage supplying means. By such a configuration, a minute discharge can occur in a gap between the paper sheet and the semiconductive electrode. The surface of the paper sheet is charged by the discharge. At this time, a conventional corona discharger is not used for charging the paper sheet, so that the surface of the paper sheet could not be charged immoderately. As a result, a phenomenon that the toner on the intermediate transfer belt flies to the paper sheet before the paper sheet reaches to the transfer position can be prevented.

Furthermore, it is preferable that a position where a predetermined voltage is applied to the intermediate transfer belt for transferring the toner image from the photoreceptor is placed in downstream part of the movement of the intermediate transfer belt from a contacting position of the intermediate transfer belt and the photoreceptor. By such a configuration, electric potential at a position in the upstream part of the movement of the intermediate transfer belt becomes lower than the electric potential at the contacting position. Thus, electric discharge which occurs in the closing region of the intermediate transfer belt and the photoreceptor can be prevented. As a result, erroneous transfer of the toner between the intermediate transfer belt and the photoreceptor will not occur, and perturbation of the picture image can be prevented.

Furthermore, it is preferable further to comprise separating means for separating the intermediate transfer belt from the photoreceptor in the same direction as the direction of the revolutionary movement of the image forming units. By such a configuration, the photoreceptor will not contact the surface of the intermediate transfer belt while the image forming units are moved, so that the toner images on the surface of the intermediate transfer belt will not be damaged by the slippage of the photoreceptor. Furthermore, the driving load of the image forming units will not be increased due to the friction force between the photoreceptor and the intermediate transfer belt.

Another color image forming apparatus of this invention comprises, a plurality of image forming units which are circularly arranged and revolutionally movable, and respectively having a rotating photoreceptor, charging means for electrically charging a surface of the photoreceptor, developing means containing different colored toner, and cleaning means for removing the toner remaining on the photoreceptor, an endless intermediate transfer belt having conductivity and a surface to which toner images formed by the image forming units are transferred and superimposed thereon, a pressure roller disposed inside the intermediate transfer belt and pressing a part of the surface of the intermediate transfer belt to the photoreceptor of the image forming unit which faces the pressing roller, an electrode contacting the intermediate transfer belt for supplying a predetermined voltage to the intermediate transfer belt, separating means for changing the position of the pressure roller for separating the surface of the intermediate transfer belt from the surface of the photoreceptor, driving means for revolutionally moving the image forming units in a manner so that one of the image forming units including a color toner, which is to be used for next toner image forming, is to be placed at a transfer position where the toner image is transferred to the intermediate transfer belt, after the prior toner image forming has been completed, a transfer roller pressing a paper sheet to the intermediate transfer belt for re-transferring the toner images to a surface of the paper sheet from the intermediate transfer belt, and a cleaning electrode contacting the surface of the intermediate transfer belt when the intermediate transfer belt is separated from the photoreceptor, and removing the toner remained on the surface of the intermediate transfer belt when a predetermined voltage is applied thereto.

By the above-mentioned configuration, the remaining toner on the surface of the intermediate transfer belt can be removed while the image forming units are moved for standing by the next color picture image forming. Thus, the movement of the pressing roller becomes single action, and the driving mechanism of the color image forming apparatus can be made simple.

Still another color image forming apparatus of this invention comprises, a plurality of image forming units which are circularly arranged and revolutionally movable, and respectively having a rotating photoreceptor, charging means for electrically charging a surface of the photoreceptor, developing means containing different colored toner, and cleaning means for removing the toner remaining on the photoreceptor, an endless intermediate transfer belt having conductivity and a surface to which toner images formed by the image forming units are transferred and superimposed thereon, a pressure roller disposed inside the intermediate transfer belt and pressing a part of surface of the intermediate transfer belt to the photoreceptor of the image forming unit which faces the pressing roller, an electrode contacting the intermediate transfer belt for supplying a predetermined voltage to the intermediate transfer belt, separating means for changing the position of the pressure roller for separating the surface of the intermediate transfer belt from the surface of the photoreceptor, driving means for revolutionally moving the image forming units in a manner so that one of the image forming units including a color toner, which is to be used for next toner image forming, is to be placed at a transfer position where the toner image is transferred to the intermediate transfer belt, after the prior toner image forming has been completed, a transfer roller pressing a paper sheet to the intermediate transfer belt for re-transferring the toner images to a surface of the paper sheet from the intermediate transfer belt, first electric power supplying means for supplying a first voltage to the transfer roller, wherein the value and polarity of the first voltage can freely be changeable, and second electric power supplying means for supplying a second voltage to the intermediate transfer belt, wherein the value and polarity of the second voltage can freely be changeable in a manner such that the first voltage has a polarity the same as that of the charge of the toner while the intermediate transfer belt moves at least one turn after all the toner images are transferred to the intermediate transfer belt from the photoreceptors.

By the above-mentioned configuration, an electrostatic repulsive force acts on the toner images on the intermediate transfer belt, and an electrostatic attractive force acts on the transfer roller. Thus, the transfer of the toner images from the intermediate transfer belt to the paper sheet, which is nipped between the intermediate transfer belt and the transfer roller, becomes effective. Furthermore, cleaning effect, which is a phenomenon that the toner remaining on the intermediate transfer belt returns to the photoreceptor of the image forming unit of, for example, black, can be achieved.

Furthermore, it is preferable that the transfer roller is distant from the pressure roller with a predetermined distance which is longer than a width of a picture image to be formed. The first and second electric power supplying means which supply the first and second voltages respectively preferably have a different polarity than the transfer roller and the intermediate transfer belt. By such a configuration, the polarity of the first voltage which is applied to the transfer roller can be changed at the same time when the transfer of the last toner image from the photoreceptor to the intermediate transfer belt is completed. Thus, configuration of the electric power supplying means can be simplified.

DETAILED DESCRIPTION OF THE INVENTION

FIRST EMBODIMENT

Figure 1:
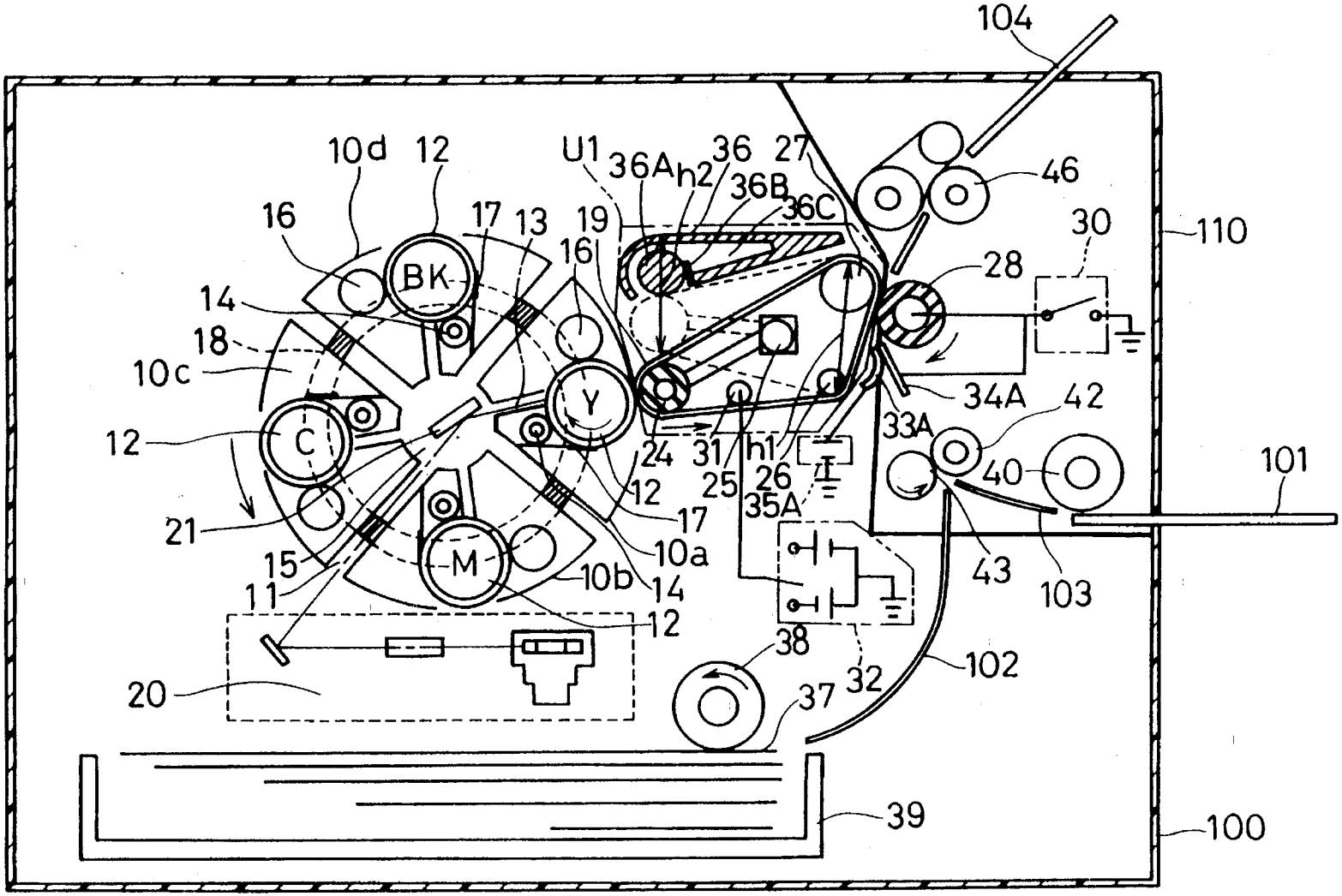
FIG. 1 is a cross-sectional side view showing a configuration of a color image forming apparatus of a first embodiment of this invention.

A color image forming apparatus of the first embodiment of this invention is shown in FIG. 1. In FIG. 1, image forming units 10*a* to 10*d* respectively correspond to colors of yellow (Y), magenta (M), cyanogen (C) and black (BK). Each image forming unit 10*a* to 10*d* comprises a photoreceptor 12 having a diameter of about 30 mm, a charging roller 14, a developing device 16, a cleaning blade 17, and so on. Each image forming unit 10*a* to 10*d* is configured by two blocks of a developing part and a toner recycling part. The developing part includes the photoreceptor 12 and the developing device 16. The toner recycling part includes the charging roller 14 and the cleaning blade 17. The image forming units 10*a* to 10*d* are rotatable around a rotation center of the units by an image forming units driving apparatus 18. The image forming units 10*a* to 10*d* can temporarily stop at a position where the photoreceptor 12 can contact an intermediate transfer belt 19. The intermediate transfer belt 19 holds toner images formed on the photoreceptor 12. When the image forming units 10*a* to 10*d* are rotated in a counterclockwise direction in the figure, each image forming unit 10*a* to 10*d* reaches an image forming position where a surface of the photoreceptor 12 is selectively exposed by an exposing device 20. At the image forming position, the developing part of the image forming unit 10*a* to 10*d* is positioned above the toner recycling part.

A light beam output from the exposing device 20 passes a slit 11 between the adjoining two image forming units, for example, 10*c* and 10*d*, and enters in a center space 15. The light beam is reflected by a mirror 21 which is disposed in the center space 15, and passes a slit 13 between the developing part and the toner recycling part of the image forming unit, for example, 10*a*. The light beam passing through the slit 13 exposes the surface of the photoreceptor 12. The mirror 21 is fixed and not rotative, even when the image forming units 10*a* to 10*d* revolve.

The intermediate transfer belt 19, which is extended by three rollers of a pressure roller 24, an extension roller 26 and a driving roller 27, is disposed in the vicinity of the image forming unit, for example, 10*a*. A toner image corresponding to each color and developed by each image forming unit 10*a* to 10*d* is transferred on a surface of the intermediate transfer belt 19 and superimposed thereon. A circumference of the intermediate transfer belt 19 is longer than 377 mm for holding at least a picture of A4 sized sheet of paper.

Material of the intermediate transfer belt 19 is a film which is made by mixing and kneading a mixture of conductive filler with an insulative resin and flattened by an extruder. In this embodiment, a mixture containing 5 wt % of conductive carbon and 95 wt % of the insulative resin such as polycarbonate resin was used. Thickness of the film was about 150 μm. Antioxidant, dispersant, mold releasing agent, and so on can be contained in the resin mixture. Electric resistance of the film was in a range of about $10^9$ to $10^{10}$ Ω·cm. Surface roughness of the film was in a range of about 8 to 10 μm by ten points meaning roughness. In consideration of cleaning of the toner from the intermediate transfer belt 19, it is preferable that the surface roughness of the intermediate transfer belt 19 is less than an approximate value of a diameter of the toner particle which is to be used in the development. The electric resistance of the intermediate transfer belt 19 is effective in a range of $10^5$ to $10^{12}$ Ω·cm. If the electric resistance of the intermediate transfer belt 19 is smaller than $10^5$ Ω·cm, discharge between the intermediate transfer belt 19 and the photoreceptor 12 or a transfer roller 28 for transferring the toner images from the intermediate transfer belt 19 to a paper sheet will occur. If the electric resistance of the intermediate transfer belt 19 is larger than $10^{12}$ Ω·cm, the ratio of insulative resin in the material of the intermediate transfer belt 19 becomes larger and a voltage which is to be applied to the intermediate transfer belt 19 must be higher. Furthermore, a change of the circumference becomes larger, and the electric resistance of the intermediate transfer belt 19 becomes uneven. Thus, the transfer effect between the photoreceptor 12 and the intermediate transfer belt 19 would be uneven in places. The intermediate transfer belt 19 is not limited as the above-mentioned configuration. It is preferable that a conductive layer is spread on an insulative base member. In this case, polyethylene telephthalate (PET), polyimide, polyamide, polyurethane, and the like are used of the material of the insulative base member. The conductive layer is formed by spraying or dip coating a conductive material in which conductive filler is dispersed in an insulative resin.

The pressure roller 24 is comprised of a metal shaft having a diameter of 10 mm and a conductive formed sponge layer on the metal shaft. The diameter of the pressure roller 24 was about 19 mm. The hardness of the formed sponge layer was smaller than 30 degrees by JIS (Japanese Industrial Standard) A-standard. The material of the formed sponge layer is urethane foam and the like. When the image forming units 10*a* to 10*d* revolve, the pressure roller 24 is moved by a separating device 25 in a manner so that the intermediate transfer belt 19 is separate from the surface of one of the photoreceptors 12 of the image forming units 10*a* to 10*d*.

A transfer roller 28 is disposed for facing the driving roller 27 via the intermediate transfer belt 19. The transfer roller 28 serves as a backup roller when the toner images on the intermediate transfer belt 19 are transferred to a paper sheet 37. The transfer roller 28 is comprised of a metal shaft having a diameter of about 10 mm and a conductive polyurethane formed layer containing conductive material such as lithium salt. The diameter of the transfer roller 28 was about 19 mm. The hardness of the polyurethane formed layer was smaller than 30 degrees by JIS A-standard. The electric resistance of the transfer roller 28 was about $10^7$ Ω·cm. While the toner images are transferred to the intermediate transfer belt 19 from the photoreceptors 12 of the image forming units 10*a* to 10*d*, a switch 30, which is inserted between the transfer roller 28 and the ground, is turned off so that the transfer roller 28 is electrically floated. As a switch 30, a relay and the like are used. When the toner images on the intermediate transfer belt 19 are transferred to the paper sheet 37, the switch 30 is turned on so that the potential of the transfer roller 28 is grounded.

An electrode 31 is provided to contact the inside face of the intermediate transfer belt 19. The electrode 31 is connected to an intermediate transfer electric power supply 32 in order to apply a predetermined voltage to the intermediate transfer belt 19. The electrode 31 is trailingly rotated by the movement of the intermediate transfer belt 19. In this embodiment, a stainless steel shaft having a diameter of about 10 mm was used as the electrode 31. A contacting position of the electrode 31 and the intermediate transfer belt 19, where the voltage from the intermediate transfer electric power supply 32 is applied to the intermediate transfer belt 19 by the electrode 31, is placed in the downstream part of the movement of the intermediate transfer belt 19 from a first transfer position. At the first transfer position, one of the photoreceptors 12 contacts the intermediate transfer belt 19. As mentioned above, the intermediate transfer belt 19 is made of an electric resistive material. When the voltage is applied to the intermediate transfer belt 19 at a downstream point from the first transfer position, the potential at an upstream point from the first transfer position becomes lower than the applied voltage. As a result, a phenomenon that the toner on the photoreceptor 12 flies to the intermediate transfer belt 19 before the toner reaches the first transfer position can be prevented. While the separating device 25 is driven, the electrode 31 evacuates with the intermediate transfer belt 19. The intermediate transfer electric power supply 32 can freely supply the voltage having a polarity which is the same as or opposite to the polarity of the toner.

A semiconductive electrode 33A and a guide 34A are disposed below and in the vicinity of the transfer roller 28. The semiconductive electrode 33A faces the guide 34A. The semiconductive electrode 33A is made of a film similar to the material of the intermediate transfer belt 19. Electric resistance of the semiconductive electrode 33A is in a range of $10^7$ to $10^8$ Ω·cm. The semiconductive electrode 33A is connected to a transfer electric power supply 35A and contacts the guide 34A, slightly. When the paper sheet 37 passes between the semiconductive electrode 33A and the guide 34A, a voltage is applied to the semiconductive electrode 33A by the transfer electric power supply 35, so that electric discharge occurs between a minute gap between the semiconductive electrode 33A and the paper sheet 37. As a result, the surface of the paper sheet 37 is electro-statically charged. By the electric charge on the surface of the paper sheet 37, the toner images on the intermediate transfer belt 19 are transferred to the surface of the paper sheet 37. As mentioned above, the switch 30 is turned on for grounding the potential of the transfer roller 28, while the toner images are transferred to the paper sheet 37.

A cleaning apparatus 36, which removes the toner remaining on the surface of the intermediate transfer belt 19, is disposed above the intermediate transfer belt 19. The cleaning apparatus 36 comprises a roller electrode 36A which can contact and be separated from the intermediate transfer belt 19 by the operation of the separating device 25. While the image forming units 10*a* to 10*d* are revolutionally moved, the roller electrode 36A contacts the intermediate transfer belt 19. The roller electrode 36A is comprised of a metal shaft and a conductive sponge layer formed on an outer surface of the metal shaft. When a voltage having a polarity opposite to the polarity of the charge of the toner is applied to the roller electrode 36A, the toner on the intermediate transfer belt 19 is adhered on the roller electrode 36A. As a result, the toner is removed from the intermediate transfer belt 19. The toner adhered on the surface of the roller electrode 36A is scraped by a scraper 36B and removed into a toner box 36C in the cleaning apparatus 36. When the image forming units 10*a* to 10*d* are revolved in order to change the toner corresponding to the color which is to be developed next, the roller electrode 36A of the cleaning apparatus 36 contacts the intermediate transfer belt 19. Thus, a voltage having the same polarity as that of the charge of the toner is applied to the roller electrode 36A in order not to remove the toner on the intermediate transfer belt 19, erroneously. Alternatively, it is preferable to configure the intermediate transfer belt 19 to be held at a midway position where the intermediate transfer belt 19 does not contact the roller electrode 36A of the cleaning apparatus 36 or the photoreceptor 12 of the image forming units 10*a* to 10*d*.

A paper feed system includes a cassette mechanism and a manual paper supplying mechanism. The cassette mechanism, which is disposed below the exposing device 20, is comprised of a cassette tray 39, a paper supplying roller 38, and so on. The cassette tray 39 contains paper sheets 37 which are piled up. The paper supplying roller 38 picks up the paper sheet 37 one by one from the cassette tray 39, and the paper sheet 37 is brought into a second transfer position. At the second transfer position, the transfer roller 28 contacts the intermediate transfer belt 19. On the other hand, the manual paper supplying mechanism comprises a manual paper supplying roller 40 which is disposed in the vicinity of a manual paper supplying gate 101 of a housing 100. The paper sheet (not shown in the figure) which is supplied from the manual paper supplying gate 101 is brought into the second transfer position by the rotation of the manual paper supplying roller 40.

A timing roller 42 and a metal roller 43 are disposed between the transfer roller 28 and the cassette tray 39 or the manual paper supplying roller 40. The timing roller 42 forwards the paper sheet 37, which is supplied from the cassette tray 39 or the manual paper supplying gate 101, to the second transfer position in a manner so that the top of the paper sheet 37 coincides with the top of a picture image signal. A paper supplying guide 102 is provided between the timing roller 42 and the metal roller 43 and the cassette tray 39. Another paper supplying guide 103 is provided between the timing roller 42 and the metal roller 43 and the manual paper supplying gate 101. It is preferable that a scraper (not shown in the figure) is provided on the metal roller 43 for removing paper particles.

A fixing device 46 is disposed above the second transfer position where the transfer roller 28 contacts the intermediate transfer belt 19. The fixing device 46 fixes the toner images on the paper sheet, which is transferred from the intermediate transfer belt 19, by supplying heat and/or pressure. The paper sheet 37 on which the toner images are fixed is ejected from the ejection gate 104 of the housing 100.

The photoreceptor 12 in each image forming unit 10*a* to 10*d* is rotated in a peripheral velocity of 33 mm/s. A moving velocity of the intermediate transfer belt 19 is faster by about 1 to 5% than the velocity of the photoreceptor 12. If the moving velocity of the intermediate transfer belt 19 is slower than the peripheral velocity of the photoreceptor 12, a friction force between the intermediate transfer belt 19 and the photoreceptor 12 becomes a burden to the driving force of the photoreceptor 12. The burden due to the intermediate transfer belt 19 would be the cause of jitter of the photoreceptor 12. Similarly, the transfer roller 28 and the intermediate transfer belt 19 are moved with the above-mentioned difference between their peripheral velocitys.

The intermediate transfer belt 19, the pressure roller 24, the extension roller 26, the driving roller 27, the electrode 31, and the cleaning apparatus 36 are integrally united in a package U1. When the package U1 is interchanged, the roller electrode 36A of the cleaning apparatus 36 and the intermediate transfer belt 19 are contacted. Thus, the scattering of the toner from the toner hopper 36C in the cleaning apparatus 36 can be prevented. Furthermore, when the intermediate transfer belt 19 contacts the roller electrode 36A of the cleaning apparatus 36 as shown by dotted line in FIG. 1, a total width h2 of the pressure roller 24 and the cleaning apparatus 36 is smaller than a width h1 between the extension roller 26 and the driving roller 27. Because, if the width h1 is large than the width h2, the package U1 can not taken out from the housing 100.

On the other hand, the manual paper supplying roller 40, the timing roller 42, the metal roller 43, the transfer roller 28 and the fixing device 46 are provided in a cover 110 of the color image forming apparatus. By such a configuration, the above-mentioned package U1 can easily be pulled out to the outside of the apparatus from a part of the transfer roller 28, when the cover 110 is opened. As a result, the maintenance of the color image forming apparatus can be increased.

Next, color image forming processes of the above-mentioned apparatus of the first embodiment are described. For printing a color picture image, toner images are formed in order of yellow (Y), magenta (M), cyanogen (C) and black (BK). At first, when the picture image data of yellow is output from a control device (not shown in the figure), the image forming units 10*a* to 10*d* revolve so that the image forming unit 10*a* of yellow stops at the position horizontally contacting the intermediate transfer belt 19. The intermediate transfer belt 19 is moved by the separating device 25 in synchronism with the revolution of the image forming units 10*a* to 10*d*, and it contacts the photoreceptor 12 of the image forming unit 10*a* of yellow. The exposing device 20 outputs the laser light beam corresponding to the yellow image data, and selectively exposes the surface of the photoreceptor 12. The latent image formed on the surface of the photoreceptor 12 is developed by the yellow toner by a developing process which is similar to the conventional monochromatic printer. In this embodiment, a reversal development system, in which the photoreceptor 12 is negatively charged and the toner is also negatively charged, was used.

The yellow toner image formed on the surface of the photoreceptor 12 is transferred to the surface of the intermediate transfer belt 19 to which an intermediate transfer voltage having a predetermined polarity and value is applied by the intermediate transfer electric power supply 32 via the electrode 31. In this embodiment, the intermediate transfer voltage applied to the intermediate transfer belt was +500 V. The yellow toner remaining on the surface of the photoreceptor 12 is removed by the cleaning blade 17 and will be recycled in the next developing process.

When the yellow toner image of a first stage is transferred to the surface of the intermediate transfer belt 19, the separating device 25 is driven for separating the intermediate transfer belt 19 from the photoreceptor 12 of the image forming unit 10*a* of yellow. The intermediate transfer belt 19 contacts the roller electrode 36A of the cleaning apparatus 36. At this time, a voltage having the same polarity as that of the toner is applied to the roller electrode 36A of the cleaning apparatus 36. Thus, the toner which forms the toner image on the intermediate transfer belt 19 is not collected in the cleaning apparatus 36. The image forming units 10*a* to 10*d* revolve simultaneously with the evacuate operation of the intermediate transfer belt 19 so that the image forming unit 10*b* of magenta stops at the position horizontally contacting the intermediate transfer belt 19. When the revolution of the image forming units 10*a* to 10*d* is completed, the separating device 25 is driven in the opposite direction. The intermediate transfer belt 19 contacts the photoreceptor 12 of the image forming unit 10*b* of magenta. After that, the magenta toner image is formed on the photoreceptor 12 by the developing process substantially the same as the above-mentioned yellow toner image forming process. An intermediate transfer voltage of about +600 V is applied to the intermediate transfer belt 19 by the intermediate transfer power supply 32, so that the magenta toner image is transferred to and superimposed on the yellow toner image on the intermediate transfer belt 19. Hereupon, the intermediate transfer voltage of +600 V, which is applied to the intermediate transfer belt 19 when the magenta toner image was developed, is higher about 100 V than the intermediate transfer voltage when the yellow toner image was developed. Thus, the yellow toner previously transferred to the intermediate transfer belt 19 may not be re-transferred to the photoreceptor 12 of the image forming unit 10*b* of magenta.

Similarly, an intermediate transfer voltage of +700 V is applied to the intermediate transfer belt 19, and the cyanogen toner image is superimposed on the yellow and magenta toner images. Furthermore, an intermediate transfer voltage of +800 V is applied to the intermediate transfer belt 19, and the black toner image is superimposed on the yellow, magenta and cyanogen toner images. As a result, a color picture image by the toner images of four colors is formed on the intermediate transfer belt 19. While the toner images of four colors are formed, the transfer roller 28 contacts the intermediate transfer belt 19. However, a circuit between the transfer roller 28 and the ground is cut off by the switch 30, so that the transfer roller 28 is electrically floated. Thus, induction electric current due to the electric charge of the toner and/or the intermediate transfer belt 19 does not flow into the transfer roller 28. The toner image on the intermediate transfer belt 19 may not be transferred to the transfer roller 28.

When the transfer of the fourth color of black toner image to the intermediate transfer belt 19 is started, the paper sheet 37 is started to be conveyed by the driving force of the paper supplying roller 38 or manual paper supplying roller 40 timed with the top of the picture image. Timing for supplying the paper sheet 37 is adjusted by the timing roller 42 and the metal roller 43 in a manner so that the top of the paper sheet 37 and the top of the toner images coincide with each other. After that, the paper sheet 37 is supplied between the semiconductive electrode 33A and the guide 34A. A transfer voltage of about +1000 V, which has a polarity opposite to the polarity of the toner, is applied to the semiconductive electrode 33A by the transfer electric power supply 35A. Thus, the surface of the paper sheet 37 is electrically charged. The paper sheet 37 passing between the semiconductive electrode 33A and the guide 34A is supplied between the transfer roller 28 and the intermediate transfer belt 19.

The switch 30 is turned on just before when the top of the paper sheet 37 reaches to the second transfer position where the intermediate transfer belt 19 contacts the transfer roller 28. The toner image on the intermediate transfer belt 19 is transferred to the paper sheet 37. When the transfer process of the toner images to the paper sheet 37 is completed, the paper sheet 37 passes through heated rollers of the fixing device 46. Thereby, the toner images are fixed on the paper sheet 37. The paper sheet 37 on which the color picture image is formed is ejected to the outside of the apparatus.

When the last end of the toner image of black on the photoreceptor 12 of the image forming unit 10*d* of black is transferred to the intermediate transfer belt 19, the value and polarity of the voltage applied to the intermediate transfer belt 19 by the intermediate transfer electric power supply 32 is changed from +800 V to −1000 V. At least while the intermediate transfer belt 19 moves more than one turn from the time when the intermediate transfer electric power supply 32 is switched, the voltage of −1000 V which is the same polarity as that of the toner is applied to the intermediate transfer belt 19. Toner which is not transferred to the paper sheet 37 is remaining on the intermediate transfer belt 19. The toner remaining on the intermediate transfer belt 19 is returned to the photoreceptor 12 of the image forming unit 10*d* of black by the electrostatic force due to the voltage having the same polarity as that of the toner. The toner returned to the photoreceptor 12 of the image forming unit 10*d* of black is collected into a waste toner box by the cleaning blade 17.

When the above-mentioned processes for forming the color picture image are completed, the image forming units 10*a* to 10*d* revolve to wait to form the next color picture image. The separating device 25 is driven in a manner so that the intermediate transfer belt 19 contacts the cleaning apparatus 36. At this time, the toner, which is not transferred to the paper sheet 37, remains a little on the intermediate transfer belt 19. A voltage having a polarity opposite to the polarity of the toner is applied to the roller electrode 36A of the cleaning apparatus 36, so that the toner remaining on the intermediate transfer belt 19 is collected. The cleaning operation of the cleaning apparatus 36 is continued while the intermediate transfer belt 19 rotates more than one turn.

When the cleaning operation is completed, the separating device 25 is driven in the opposite direction in a manner so that the intermediate transfer belt 19 contacts the photoreceptor 12 of the image forming unit 10*a* of yellow. The color image forming apparatus will be used for forming a new color picture image.

The transfer voltage for charging the paper sheet 37 by the transfer power supply 35A is changeable responding to the condition of the paper sheet 37. For example, when the circumstance is high humidity and high temperature, the transfer voltage is made relatively lower. On the other hand, when the circumstance is low humidity and low temperature, the transfer voltage is made higher. By such a configuration, variation of the electrical resistance of a resistance layer of the transfer roller 28 can be cancelled. Similarly, the intermediate transfer voltage applied by the intermediate transfer power supply 32, when the toner images are transferred to the intermediate transfer belt 19 from the photoreceptors 12 of the image forming units 10*a* to 10*d*, is also changeable responding to the change of the circumstances.

As mentioned above, the paper sheet 37 is previously charged, so that an amount of the electric charge, which is necessary to transfer the toner images from the intermediate transfer belt 19 to the paper sheet 37, can be supplied to the surface of the paper sheet 37, stably. Thus, the color picture image can be obtained stably without any injury by a change in the circumstances at any time. Since the necessary amount of the electric charge is supplied to the paper sheet 37, the color picture image which is actually obtained is suitable without any scattering of the toner.

Figure 2:
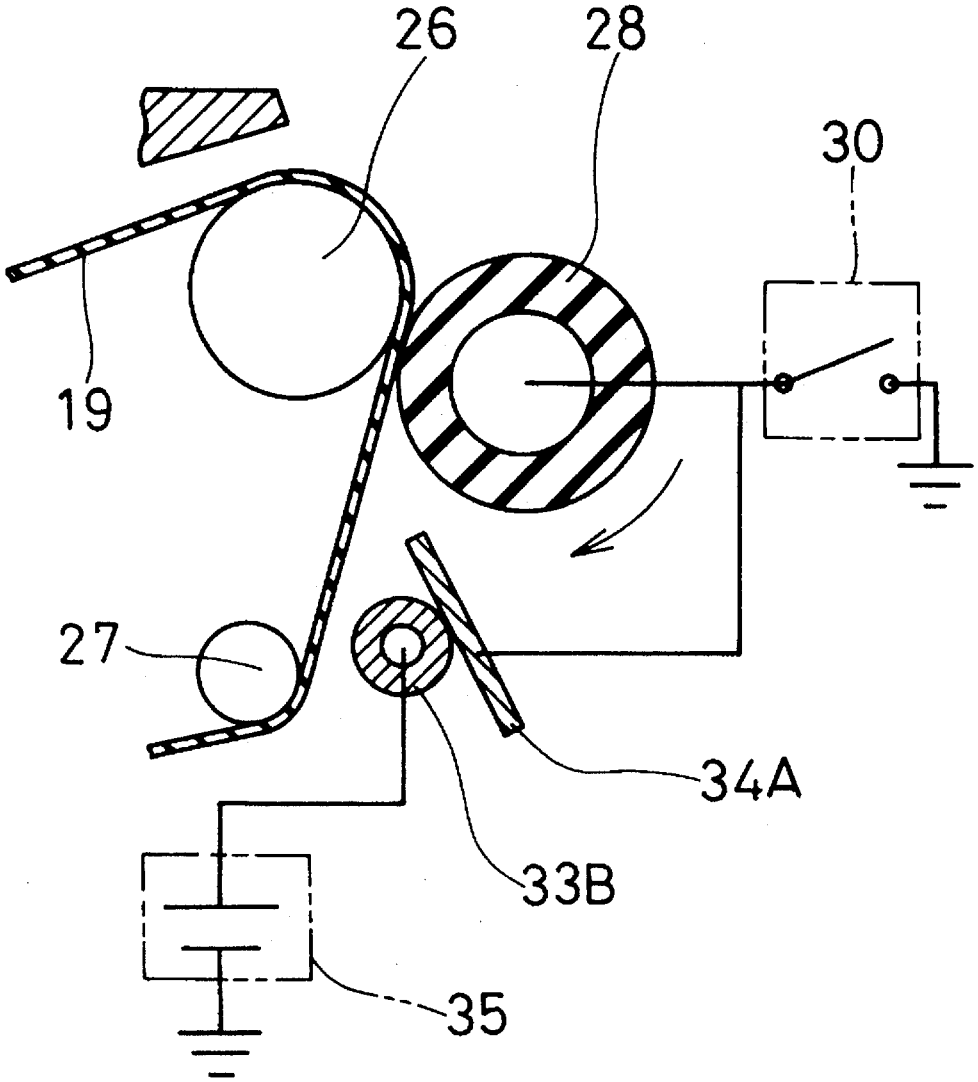
FIG. 2 is an enlarged cross-sectional side view showing another configuration of a transfer part of the color image forming apparatus of the first embodiment.
Figure 3:
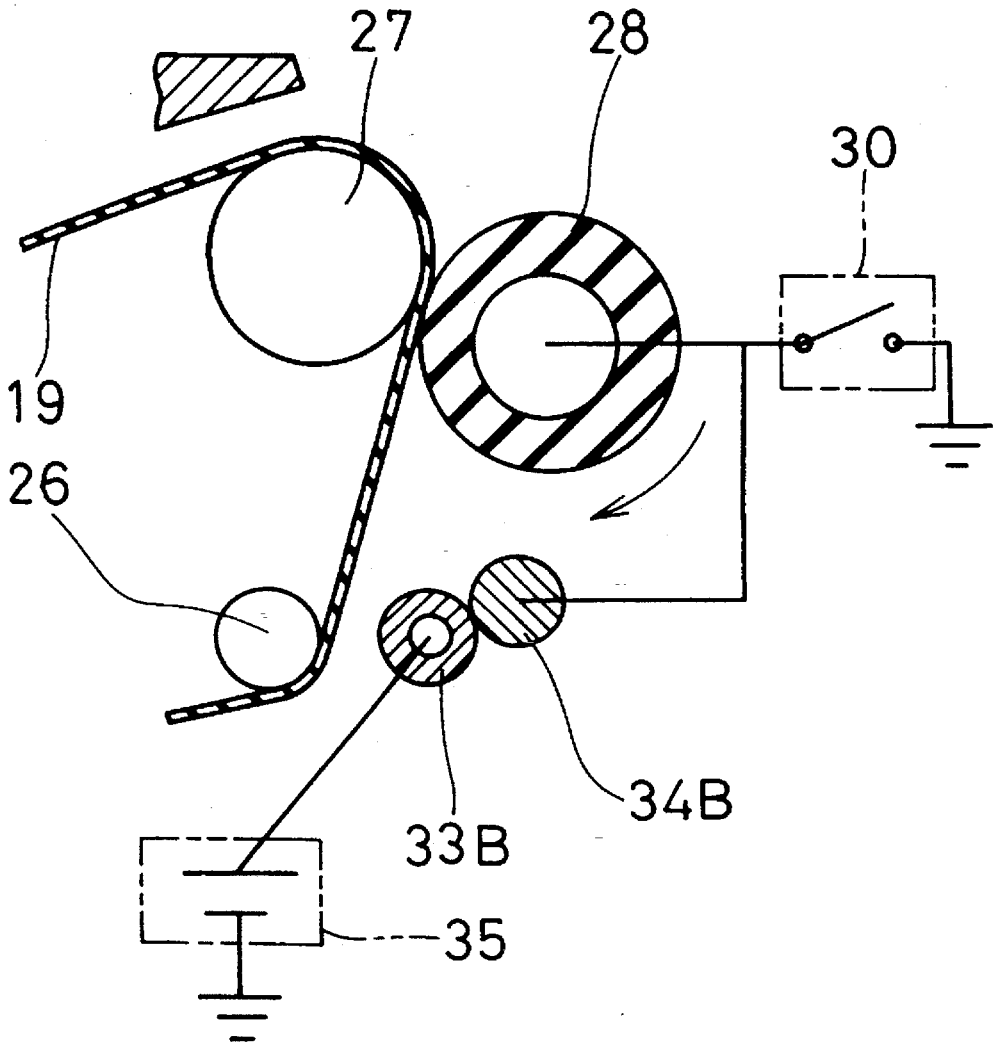
FIG. 3 is an enlarged cross-sectional side view showing still another configuration of a transfer part of the color image forming apparatus of the first embodiment.

Alternatively, as shown in FIG. 2, a roller shaped electrode 33B, which is comprised of a shaft and a semiconductive layer formed on the surface of the shaft, can be used instead of the semiconductive electrode 33A in FIG. 1. Alternatively, as shown in FIG. 3, a roller shaped electrode 33B and a guide roller 34B can be used instead of the semiconductive electrode 33A and the guide plate 34A. Electrical connections and operations of the semiconductive electrode 33A and the guide plate 34A are substantially the same as the case shown in FIG. 1. The guide roller 34B is a metal shaft and grounded similar to the guide plate 34A. Especially, the semiconductive electrode 33A and the guide plate 34A can serve as the function of the timing roller 42 and the metal roller 43.

SECOND EMBODIMENT

Figure 4:
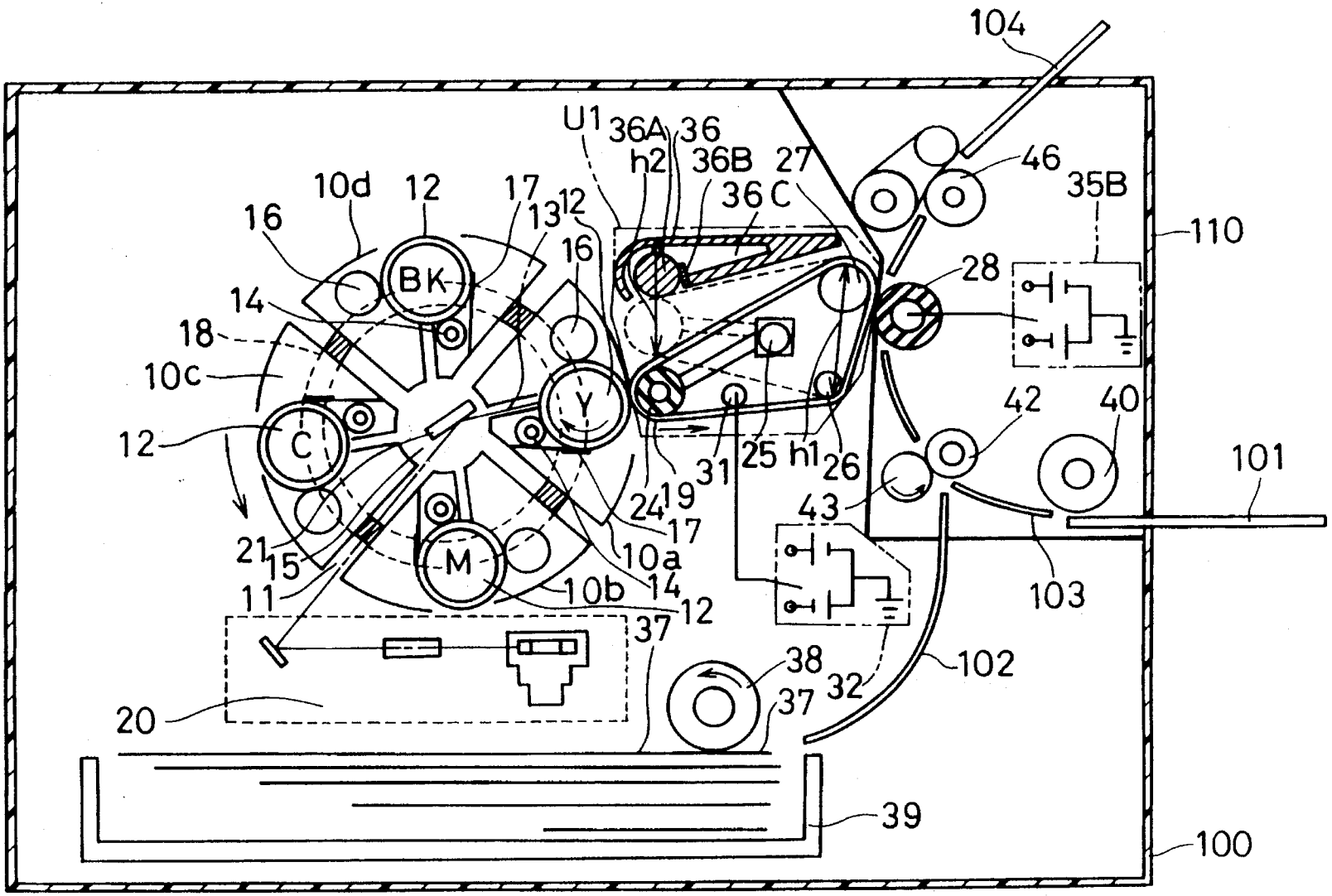
FIG. 4 is a cross-sectional side view showing a configuration of a color image forming apparatus of a second embodiment of this invention.

A second embodiment of the color image forming apparatus of this invention is shown in FIG. 4. Elements designated by the same numerals as those in the above-mentioned first embodiment are substantially the same. Thus, explanation of the elements are omitted. In comparison with the first embodiment, the diameter of the intermediate transfer belt 19 in natural condition is about 200 mm for making the circumference length 628 mm, and the paper sheet 37 is not previously charged before the paper sheet 37 is nipped between the intermediate transfer belt 19 and the transfer roller 28.

As shown in FIG. 4, the transfer roller 28 is not grounded by a switch, but connected to a transfer electric power supply 35B. The transfer electric power supply 35B can change the polarity and value of the transfer voltage which is applied to the transfer roller 28. While the toner images are transferred to the intermediate transfer belt 19 from the photoreceptor 12 of the image forming units 10*a* to 10*d*, a voltage having the same polarity as that of the charge of the toner is applied to the transfer roller 28 by the transfer electric power supply 35B. Furthermore, when the toner images of four colors superimposed on the intermediate transfer belt 19 are transferred to the paper sheet 37, a voltage having a polarity opposite to that of the charge of the toner is applied to the transfer roller 28 by the transfer electric power supply 35B.

Since the circumference length of the intermediate transfer belt 19 is about 628 mm, a space, which can sufficiently hold a picture image of standard size of A4 (210 mm×297 mm) which is one of the standard series of Japanese paper size, can be obtained between the pressure roller 24 and the transfer roller 28. If another size of picture image is to be held on the intermediate transfer belt 19, the circumference length of the intermediate transfer belt can be adjusted according to the size of the picture image. Since the circumference length of the intermediate transfer belt 19 is made longer, the polarity of the transfer voltage which is applied to the transfer roller 28 can be changed at the same time when the transfer of the black toner image, which is the last toner image to be developed, from the photoreceptor 12 of the image forming unit 10*d* of black to the intermediate transfer belt 19 is completed.

For example, the polarity of the toner is negative, a voltage having a positive polarity is applied to the intermediate transfer belt 19 while the toner images are transferred to the intermediate transfer belt 19 from the photoreceptors 12 in each image forming unit 10*a* to 10*d*. At this time, the transfer roller 28 which contacts the intermediate transfer belt 19 is applied a voltage having a negative polarity so as to prevent the re-transfer of the toner to the transfer roller 28 from the intermediate transfer belt 19. After the transfer of all the toner images from the photoreceptor 12 in each image forming unit 10*a* to 10*d*, a voltage having the negative polarity which is the same as the polarity of the toner is applied to the intermediate transfer belt 19. A voltage having the positive polarity which is opposite to the polarity of the toner is applied to the transfer roller 28, at the same time. An attractive force due to the positive voltage applied to the transfer roller 28 and a repulsive force due to the negative voltage applied to the intermediate transfer belt 19 act on the toner on the surface of the intermediate transfer belt 19. Thus, when the paper sheet 37 is timely supplied between the intermediate transfer belt 19 and the transfer roller 28, the toner images are effectively transferred to the paper sheet 37 from the intermediate transfer belt.

In the above-mentioned color image forming apparatuses of this invention, toner images corresponding to four colors are superimposed on the intermediate transfer belt 19, so that the superimposed toner layers are relatively thick. Therefore, the above-mentioned methods for forming the color image are effective to increase the transfer effect in the above-mentioned color image forming apparatuses.

What is claimed is:

1. A color image forming apparatus comprising:

a plurality of image forming units which are circularly disposed and revolutionally movable, and respectively having a rotating photoreceptor, charging means for electrically charging a surface of said photoreceptor, developing means containing different colored toner, and cleaning means for removing toner remaining on said photoreceptor;

an endless intermediate transfer belt having conductivity and a surface to which toner images formed by said image forming units are transferred and superimposed thereon;

paper sheet charging means for charging a surface of a paper sheet before said toner images are transferred from said intermediate transfer belt;

a conductive electrode for nipping said paper sheet which is previously charged by said paper sheet charging means between said conductive electrode and said intermediate transfer belt;

voltage supplying means for supplying a predetermined voltage to said conductive electrode when said toner images superimposed on said intermediate transfer belt are transferred to said paper sheet; and switching means for turning off a circuit between said conductive electrode and said voltage supplying means to make said conductive electrode electrically float when said toner images of respective colors are superimposed on said intermediate transfer belt and said paper sheet is not between said intermediate transfer belt and said conductive electrode, and for turning on said circuit to apply said voltage to said conductive electrode when said toner images superimposed on said intermediate transfer belt are transferred to said paper sheet.

2. The color image forming apparatus in accordance with claim 1, wherein said paper sheet charging means comprises a grounded conductive guide, a semiconductive electrode which faces and contacts said conductive guide, and transfer voltage supplying means.

3. The color image forming apparatus in accordance with claim 2, wherein said semiconductive electrode is one selected from a film sheet which is made by mixing and kneading a mixture of conductive filler with an insulative resin, and a roller comprising a shaft and a semiconductive layer formed on a surface of said shaft.

4. The color image forming apparatus in accordance with claim 2, wherein said grounded conductive guide is one selected from a roller and a plate made of a conductive material.

5. The color image forming apparatus in accordance with claim 3, wherein said grounded conductive guide is one selected from a roller and a plate made of a conductive material.

6. The color image forming apparatus in accordance with claim 2, wherein said semiconductive electrode and said grounded conductive guide are respectively roller shaped, and serve as timing means for supplying a paper sheet in a manner so that a top end of said paper sheet coincides with a top end of said toner images.

7. The color image forming apparatus in accordance with claim 1, wherein a position where a predetermined voltage is applied to said intermediate transfer belt for transferring the toner image from said photoreceptor is placed in a downstream part of the movement of said intermediate transfer belt from a contacting position of said intermediate transfer belt and said photoreceptor.

8. The color image forming apparatus in accordance with claim 1, further comprising separating means for separating said intermediate transfer belt from said photoreceptor by moving said intermediate transfer belt in the same direction as a direction of revolutionary movement of said image forming units.

9. The color image forming apparatus in accordance with claim 1, wherein said conductive electrode is a roller comprised of a metal shaft and a conductive rubber layer containing conductive material, and a rotational axis of said roller is immovable against said intermediate transfer belt.

10. The color image forming apparatus in accordance with claim 1, wherein said intermediate transfer belt is a film which is made by mixing and kneading a mixture of conductive filler with an insulative resin and flattening by an extruder.

11. The color image forming apparatus in accordance with claim 10, wherein at least one of antioxidant, dispersant and mold releasing agent is contained in the mixture of resin.

12. The color image forming apparatus in accordance with claim 1, wherein a predetermined voltage having a polarity opposite to a polarity of said toner is applied to said intermediate transfer belt while said toner images are transferred to said intermediate transfer belt from said photoreceptors, and an absolute value of said predetermined voltage is increased for each successive color toner image which is transferred to said intermediate transfer belt from said photoreceptors.

13. A color image forming apparatus comprising:

a plurality of image forming units which are circularly arranged and revolutionally movable, and respectively having a rotating photoreceptor, charging means for electrically charging a surface of said photoreceptor, developing means containing different colored toner, and cleaning means for removing said toner remaining on said photoreceptor;

an endless intermediate transfer belt having conductivity and a surface to which toner images formed by said image forming units are transferred and superimposed thereon;

a pressure roller disposed inside said intermediate transfer belt and pressing a part of the surface of said intermediate transfer belt to said photoreceptor of said image forming unit which faces said pressure roller;

an electrode contacting said intermediate transfer belt for supplying a predetermined voltage to said intermediate transfer belt;

separating means for changing a position of said pressure roller for separating said surface of said intermediate transfer belt from said surface of said photoreceptor;

driving means for revolutionally moving said image forming units in a manner so that one of said image forming unit including a color toner, which is to be used for the formation of a next toner image, is to be placed at a transfer position where said toner image is transferred to said intermediate transfer belt, after formation of a prior toner image has been completed;

a transfer roller pressing a paper sheet to said intermediate transfer belt for re-transferring said toner images to a surface of said paper sheet from said intermediate transfer belt; and a cleaning electrode contacting said surface of said intermediate transfer belt when said intermediate transfer belt is separated from said photoreceptor, and removing said toner remaining on said surface of said intermediate transfer belt when a predetermined voltage is applied thereto when said image forming units are moved for standing by a next image forming.

14. The color image forming apparatus in accordance with claim 13, wherein said predetermined voltage applied to said cleaning electrode has a polarity opposite to a polarity of said toner.

15. A color image forming apparatus comprising:

a plurality of image forming units which are circularly arranged and revolutionally movable, and respectively having a rotating photoreceptor, charging means for electrically charging a surface of said photoreceptor, developing means containing different colored toner, and cleaning means for removing said toner remaining on said photoreceptor;

an endless intermediate transfer belt having conductivity and a surface to which toner images formed by said image forming units are transferred and superimposed thereon;

a pressure roller disposed inside said intermediate transfer belt and pressing a part of the surface of said intermediate transfer belt to said photoreceptor of said image forming unit which faces said pressure roller;

an electrode contacting said intermediate transfer belt for supplying a predetermined voltage to said intermediate transfer belt;

separating means for changing a position of said pressure roller for separating said surface of said intermediate transfer belt from said surface of said photoreceptor;

driving means for revolutionally moving said image forming units in a manner so that one of said image forming unit including a color toner, which is to be used for the formation of a next toner image, is to be placed at a transfer position where said toner image is transferred to said intermediate transfer belt, after formation of a prior toner image has been completed;

a transfer roller pressing a paper sheet to said intermediate transfer belt for re-transferring said toner images to a surface of said paper sheet from said intermediate transfer belt;

first electric power supplying means for supplying a first voltage to said transfer roller, wherein the value and polarity of said first voltage can freely be changeable; and second electric power supplying means for supplying a second voltage to said intermediate transfer belt, wherein the value and polarity of said second voltage can be freely changeable in a manner so that said first voltage has a polarity the same as that of said charge of said toner while said intermediate transfer belt moves at least one turn after all said toner images are transferred to said intermediate transfer belt from said photoreceptors.

16. The color image forming apparatus in accordance with claim 15, wherein said transfer roller is distant from said pressure roller with a predetermined distance which is longer than a width of a picture image to be formed; said first and second electric power supplying means supply said first and second voltages respectively having different polarity to said transfer roller and said intermediate transfer belt.

17. A method for forming a color image comprising steps of:

revolutionally moving a plurality of image forming units, which are circularly arranged and respectively have a rotating photoreceptor, charging means for electrically charging a surface of said photoreceptor, developing means containing different colored toner, and cleaning means for removing said toner remained on said photoreceptor, in a manner so that one of said image forming unit stops at a position facing an intermediate transfer belt;

forming a toner image on said photoreceptor in said image forming unit at said position;

transferring said toner image from said photoreceptor to a surface of said intermediate transfer belt;

repeating said above-mentioned steps until said toner images corresponding to all the different colors are transferred to and superimposed on said surface of said intermediate transfer belt;

electrically charging a surface of a paper sheet previously before a transfer of said toner images from said intermediate transfer belt;

switching off a conductive electrode, which nips said paper sheet between said intermediate transfer belt, for electrically floating when said toner images are superimposed on said intermediate transfer belt and said paper sheet is not between said intermediate transfer belt and said conductive electrode; and switching on said conductive electrode for supplying a predetermined voltage thereto when said toner images superimposed on said intermediate transfer belt are transferred to said paper sheet.

18. The method for forming a color image in accordance with claim 17, wherein a position where a predetermined voltage is applied to said intermediate transfer belt for transferring said toner image from said photoreceptor is placed in downstream part of the movement of said intermediate transfer belt from a contacting position of said intermediate transfer belt and said photoreceptor.

19. The method for forming a color image in accordance with claim 18, wherein a predetermined voltage having a polarity opposite to a polarity of said toner is applied to said intermediate transfer belt while said toner images are transferred to said intermediate transfer belt from said photoreceptors, and an absolute value of said predetermined voltage is increased for each successive color toner image which is transferred to said intermediate transfer belt from said photoreceptors.

* * * * *